United States Patent [19]

Parker

[11] 3,937,904

[45] Feb. 10, 1976

[54] MOVING MAGNET ELECTROACOUSTIC TRANSDUCER

[75] Inventor: Rollin James Parker, Greenville, Mich.

[73] Assignee: Hitachi Magnetics Corporation, Edmore, Mich.

[22] Filed: Aug. 7, 1974

[21] Appl. No.: 495,305

[52] U.S. Cl. ..... 179/114 R; 179/115 R; 179/117; 335/231

[51] Int. Cl.[2] ..... H04R 9/02

[58] Field of Search ..... 179/114 R, 115 R, 117; 335/231, 302, 179, 222, 229

[56] References Cited

UNITED STATES PATENTS

| | | | |
|---|---|---|---|
| 2,951,190 | 8/1960 | Baermann | 335/231 |
| 3,836,733 | 9/1974 | Craig | 335/231 |

FOREIGN PATENTS OR APPLICATIONS

| | | | |
|---|---|---|---|
| 673,649 | 6/1952 | United Kingdom | 335/302 |

*Primary Examiner*—Kathleen H. Claffy
*Assistant Examiner*—George G. Stellar
*Attorney, Agent, or Firm*—Allard A. Braddock

[57] ABSTRACT

A transducer device such as a loudspeaker or microphone has a U-shaped core of magnetically permeable material with attached pole pieces defining a gap and a stationary electrical coil around the core. A permanent magnet is positioned for movement through the central portion of the gap as directed by a variable magnetic field within the gap. The permanent magnet has diagonally positioned poles of like magnetic orientation to provide a north-south pole combination facing one of the pole pieces and a complementary south-north pole combination facing the other pole piece.

6 Claims, 1 Drawing Figure

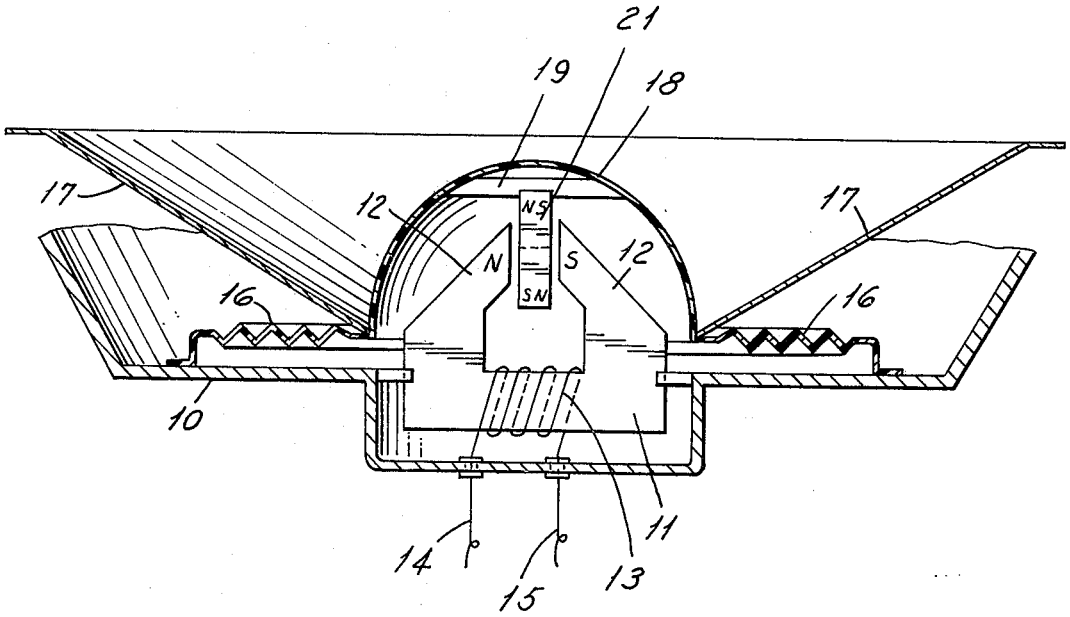
21
19
18
17
12
N
S
12
17
16
16
10
11
14
15
13

MOVING MAGNET ELECTROACOUSTIC TRANSDUCER

BACKGROUND OF THE INVENTION

The cobalt-rare earth magnets developed in recent years possess such great magnetic strength as to make moving magnet transducers a distinct practical possibility. My U.S. Pat. No. 3,798,391 discloses and claims electro-acoustic transducers utilizing cobalt-rare earth intermetallic compounds as moving-magnet members.

My U.S. Pat. application, Ser. No. 451,482, filed Mar. 15, 1974, describes and claims a moving-magnet loudspeaker in which the permanent magnet element has a circular configuration. The parts forming such a loudspeaker could be assembled with much less manual adjustment and care than was necessary for the conventional moving-coil type of loudspeaker.

SUMMARY OF THE INVENTION

This invention is directed broadly to a transducer and particularly to a loudspeaker in which the movable magnet may have a rectangular cross-sectional configuration and in which diagonally positioned poles of like magnetic orientation provide balanced radial forces and symmetrical dynamic forces in the axis of motion.

BRIEF DESCRIPTION OF THE DRAWING

The drawing is a schematic diagram of a loudspeaker incorporating the features of the present invention.

DESCRIPTION OF THE PREFERRED EMBODIMENT

The stationary parts of the loudspeaker illustrative of the invention consist of a chassis 10 in which is mounted a core 11 which is solely a simple U-shape composed of magnetically permeable material on which is mounted an electrical coil 13 which has external leads 14 and 15 for an input signal. The ends of the U-shaped member 11 are equipped with pole pieces 12 which define a gap between their protruding ends.

A flexible spider 16 mounted on the chassis 10 serves to position the movable parts of the loudspeaker. The movable parts of the speaker consist of a cone 17 mounted on the spider 16. Attached to the inner periphery of the cone 17 is a cap dome 18 having a cross member 19. Attached to the cross member 19 is a permanent magnet 21 which is movable (reciprocates) along an axis of the U-shaped core 11 in the gap between the pole pieces 12.

The permanent magnet 21 is preferably composed of a cobalt-rare earth material such as is disclosed and claimed in U.S. Pat. Nos. 3,655,463, 3,655,464, 3,695,945, and 3,684,593 which are incorporated herein by reference. In order to provide good high-frequency response, it is desirable that this member weigh less than one-half gram and preferably of the order of one-tenth to one-third gram. For convenience of illustration the pole pieces 12 are shown as having an N (for north) and S (for south) magnetic orientation. Magnet 21 is shown as having two N-S configurations with the two north poles being diagonally positioned on one diagonal axis and the two south poles being diagonally positioned on the other diagonal axis. It is not necessary that this diagonal configuration be achieved in an integral member. It can be achieved by making two separate magnetic members and fastening them to each other to achieve the magnetic configuration illustrated.

In response to a signal input on the leads 14 and 15, a variable magnetic field is established in the gap between the pole pieces 12. The polarity indicated in the drawing provides a repulsion-attraction effect in the magnet 21 from both the north and the south poles of the pole pieces 12 and this effect impels the magnet along its axis of motion. Thus, the north pole piece acts to repel the north portion of the magnet 21 immediately adjacent the cross member 19 and to attract the south pole of the magnet 21 farthest removed from the cross member 19. Similarly, the south pole piece 12 repels the south pole of the magnet 21 adjacent the cross member 19 and attracts the north pole of the magnet 21 farthest removed from the cross member 19. All magnetic orientations are in motion-aiding relationship. There is no torque applied to the magnet 21 and the forces applied to it are symmetrical in the axis of motion along the center line of the core 11.

When the transducer of this invention takes the form of a loudspeaker, it is important that the moving magnet member 21 be very light in order to provide good response at high frequencies. A magnet 21 about 0.035 inches by 0.25 inches by 4.3125 inches weighs about 0.3 gram and provides excellent fidelity at the higher frequencies.

The motion-aiding character of the magnetic forces applied to the magnet 21 by this invention provides for maximum travel in the member. This characteristic enables the invention to be used in devices other than acoustic devices. For example, this degree of travel enables the invention to be applied effectively to articles having a to-and-fro motion such as clippers and also to such articles as linear motors. Thus, while the invention has been described with reference to a particular embodiment, it is obvious that there are other embodiments which properly fall within the scope of the invention. Therefore, the invention should be limited in scope only as may be necessitated by the scope of the appended claims.

What I claim as new and desire to secure by letters patent of the United States is:

1. An electroacoustic transducer device comprising a (U-shaped) core of magnetically permeable material having solely a simple U-shape, a stationary electrical coil around said core for the creation of an electromagnetic field, a pole piece mounted on each protruding end of said core, the pole pieces defining a gap between the protruding ends of said core, a permanent magnet centrally positioned within said gap and having diagonally positioned poles of the same magnetic orientation whereby the side facing each pole piece has an end which is repelled from said pole piece and an opposite end which is attracted to said pole piece when said electrical coil is energized; and a diaphragm driven by reciprocating movement of said magnet.

2. A device as claimed in claim 1 in which the permanent magnet is composed of cobalt-rare earth intermetallic material.

3. A device as claimed in claim 2 wherein the rare earth is samarium.

4. A device as claimed in claim 1 wherein the permanent magnet is fixedly attached at an end thereof to a cap member mounted on the diaphragm of the device.

5. A device as claimed in claim 1 wherein the permanent magnet is of rectangular cross-sectional configuration.

6. A device as claimed in claim 1 consisting of a loudspeaker.

* * * * *